US007021888B2

(12) United States Patent
Jostlein

(10) Patent No.: US 7,021,888 B2
(45) Date of Patent: Apr. 4, 2006

(54) ULTRA-HIGH SPEED VACUUM PUMP SYSTEM WITH FIRST STAGE TURBOFAN AND SECOND STAGE TURBOMOLECULAR PUMP

(75) Inventor: Hans Jostlein, Naperville, IL (US)

(73) Assignee: Universities Research Association, Inc., Washington, DC (US)

( * ) Notice: Subject to any disclaimer, the term of this patent is extended or adjusted under 35 U.S.C. 154(b) by 45 days.

(21) Appl. No.: 10/737,570

(22) Filed: Dec. 16, 2003

(65) Prior Publication Data

US 2005/0129509 A1 Jun. 16, 2005

(51) Int. Cl.
*F04D 19/04* (2006.01)

(52) U.S. Cl. ..... 415/1; 415/9; 415/62; 415/66; 415/68; 415/90; 415/143; 415/229; 417/205; 417/244; 417/423.4; 417/423.12

(58) Field of Classification Search ..... 415/1, 415/60–62, 66, 68, 9, 90, 143, 229; 417/205, 417/244, 423.4, 423.12
See application file for complete search history.

(56) References Cited

U.S. PATENT DOCUMENTS 2,040,452 A * 5/1936 Troller ..... 415/192
2,171,972 A 9/1939 Debor
2,341,044 A 2/1944 Jackson et al.
3,305,121 A 2/1967 Horn et al.
3,339,831 A * 9/1967 Ranz ..... 415/206
3,356,418 A 12/1967 Healey et al.
3,536,418 A * 10/1970 Breaux ..... 415/90
3,793,145 A 2/1974 Jordan et al.
4,219,325 A * 8/1980 Gutzwiller ..... 415/192
4,343,409 A 8/1982 Silver
4,687,044 A 8/1987 Wallace
4,763,005 A 8/1988 Schumer
4,797,068 A 1/1989 Hayakawa et al.
4,964,056 A 10/1990 Bekki et al.
5,012,158 A 4/1991 Nakatani et al.
5,015,432 A 5/1991 Koloc
5,050,616 A 9/1991 Wolff et al.
5,085,887 A 2/1992 Adams et al.
5,092,740 A 3/1992 Yamamura
5,108,792 A 4/1992 Anderson et al.
5,121,852 A 6/1992 Wilkes
5,259,735 A 11/1993 Takahashi et al.
5,261,793 A 11/1993 Piltingsrud (Continued)

FOREIGN PATENT DOCUMENTS

WO WO-01/96745 A1 * 12/2001 ..... 415/220

*Primary Examiner*—Christopher Verdier
(74) *Attorney, Agent, or Firm*—McAndrews, Held & Malloy, Ltd.

(57) ABSTRACT

An ultra-high speed vacuum pump evacuation system includes a first stage ultra-high speed turbofan and a second stage conventional turbomolecular pump. The turbofan is either connected in series to a chamber to be evacuated, or is optionally disposed entirely within the chamber. The turbofan employs large diameter rotor blades operating at high linear blade velocity to impart an ultra-high pumping speed to a fluid. The second stage turbomolecular pump is fluidly connected downstream from the first stage turbofan. In operation, the first stage turbofan operates in a pre-existing vacuum, with the fluid asserting only small axial forces upon the rotor blades. The turbofan imparts a velocity to fluid particles towards an outlet at a high volume rate, but moderate compression ratio. The second stage conventional turbomolecular pump then compresses the fluid to pressures for evacuation by a roughing pump.

15 Claims, 2 Drawing Sheets

U.S. PATENT DOCUMENTS 5,404,017 A 4/1995 Inuishi et al.
5,417,551 A 5/1995 Abe et al.
5,445,502 A 8/1995 Itou et al.
5,478,210 A 12/1995 Maruyama et al.
5,513,499 A * 5/1996 deRijke ..... 415/90
5,536,148 A 7/1996 Nishiuchi et al.
5,595,477 A 1/1997 Amlinger
5,733,104 A 3/1998 Conrad et al.
5,865,896 A 2/1999 Nowak et al.
6,050,782 A 4/2000 Lembke
6,093,252 A 7/2000 Wengert et al.
6,121,569 A 9/2000 Miley et al.
6,225,744 B1 5/2001 Tobin et al.
6,245,149 B1 6/2001 De Lomenie et al.
6,270,617 B1 8/2001 Yin et al.
6,300,245 B1 10/2001 Murzin et al.
6,309,184 B1 10/2001 Moraja et al.
6,332,752 B1 * 12/2001 Ikegami et al. ..... 415/90
6,364,995 B1 4/2002 Fairbairn et al.
6,383,330 B1 5/2002 Raaijmakers
6,409,477 B1 6/2002 Blecker et al.
6,422,829 B1 7/2002 Schutz
6,483,216 B1 11/2002 Bouille et al.
6,499,973 B1 12/2002 Maejima
2002/0122729 A1 9/2002 Yamashita et al.
2002/0131870 A1 9/2002 Peuch
2003/0206800 A1 * 11/2003 Mathson et al. ..... 415/220

* cited by examiner

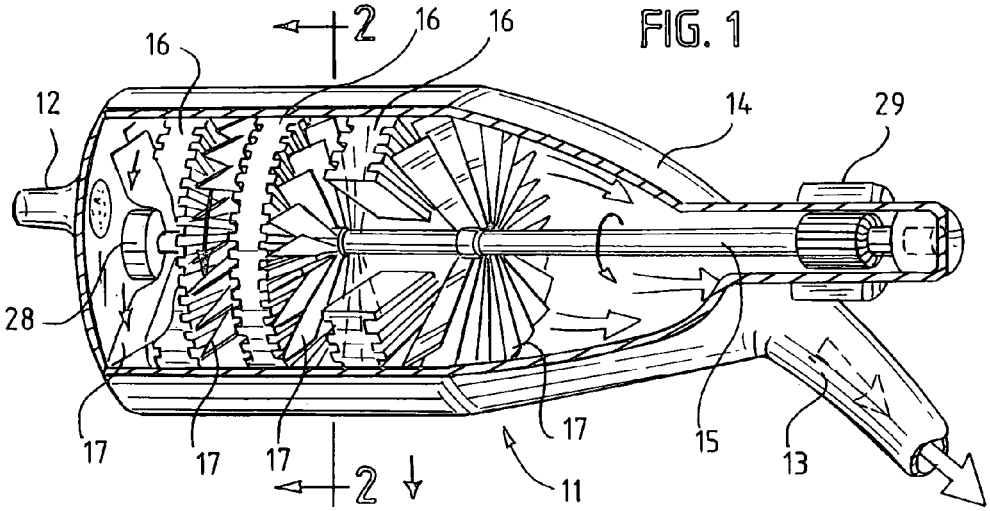
FIG. 1
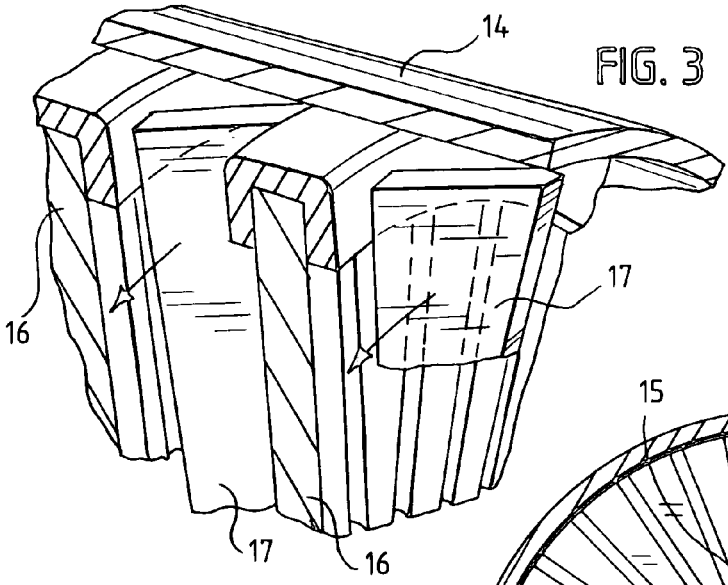
FIG. 3
FIG. 2
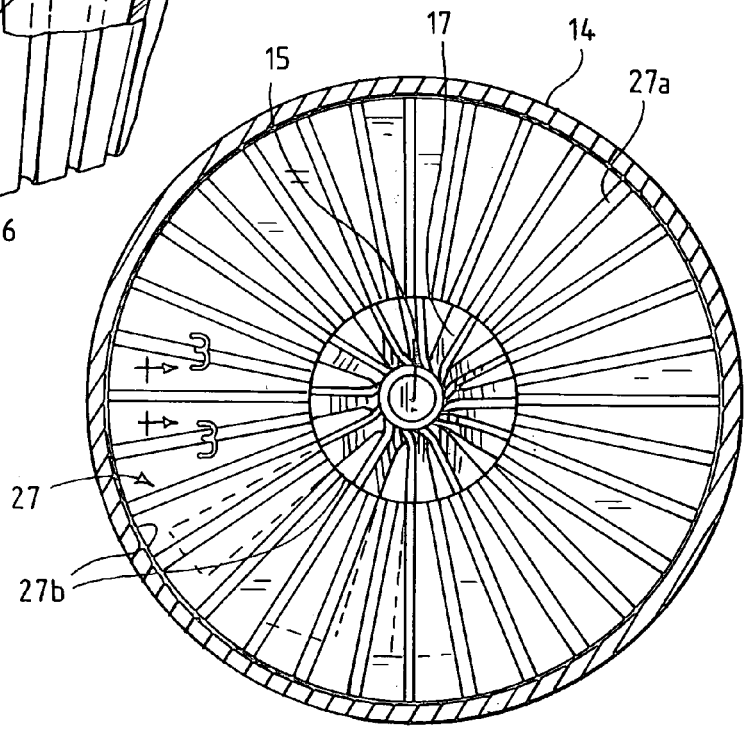

ULTRA-HIGH SPEED VACUUM PUMP SYSTEM WITH FIRST STAGE TURBOFAN AND SECOND STAGE TURBOMOLECULAR PUMP

STATEMENT REGARDING FEDERALLY SPONSORED RESEARCH

This invention was made with Government support under Contract No. DE-AC02-76CH03000, awarded by the United States Department of Energy. The Government has certain rights in the invention.

FIELD OF THE INVENTION

The present invention relates to vacuum pumps for generating ultra-high vacuum within an evacuated chamber. More specifically, the present invention relates to a vacuum pump systems that include a first stage high-speed turbofan and a second stage turbomolecular pump, as well as a method of using the vacuum pump system.

BACKGROUND OF THE INVENTION

Turbomolecular pumps (TMPs; sometimes also referred to as turbopumps) are widely employed for generating an ultra-high vacuum in an evacuated chamber. Vacuum pumps generally include turbo molecular pumps, drag pumps, centrifugal pumps, diffusion pumps, cryopumps, titanium sputter pumps, getter pumps and the like. In general, turbomolecular pumps are employed to compress gases, such as hydrogen in the $10^{-8}$ Pa ($10^{-10}$ Torr) range, to pressures for evacuation through roughing pumps (about 10 Pa). The principle underlying turbomolecular pumps is that in high vacuum, where the molecular mean free path of the remaining gas is large compared to the dimensions of the chamber, fast moving rotors impart a linear momentum to fluid particles that interact with the rotors. The relative velocity imparted to a fluid stream by the alternating rotating blades and stator blades draws the fluid from the vacuum chamber to be evacuated to the pump exhaust outlet. Each set of rotor blades and stator blades is able to support a pressure difference. For a series of blade sets, the compression ratio for zero flow is approximately the product of the compression ratios for each set. Conventional turbomolecular pumps achieve high ratios of compression by operating at a high rotational speed and by employing a large number of rotor/stator blade sets.

With a high rotational speed and greater number of rotor/stator blade sets come increased difficulties in manufacturing the pumps and in their maintenance and repair, which increases overall operational costs.

Turbomolecular pumps are available commercially for applications where pumping speeds of up to a few thousand liters per second (liter/sec) are required. Conventional turbomolecular pumps are ill-suited to achieving ultra high pumping speeds, however. Ultra high pumping speeds require very large diameter pumps. Large pump diameters are not compatible with reaching large compression ratios economically.

Turbopump bearings must support the rapidly spinning rotor in high vacuum. The output stages can require reasonably high torque and power when starting a turbo pump. These requirements are harder to meet in a large diameter turbo pump. However, the required pumping speed sets the diameter size of the rotor, and requires a large diameter pump where ultra high speeds are needed.

These partially conflicting demands limit the bearing design options and leads to short bearing service life or reliance on complex electronics, for example to stabilize a magnetic bearing.

Existing pumps use many bearing designs, including metallic and ceramic ball bearings, with oil or grease lubrication; active and passive magnetic bearings; and combinations thereof. Hence turbomolecular vacuum pumps are complex, and expensive.

Certain applications require extremely high pumping speeds at ultra low pressures. Examples include space simulation chambers, fusion reactors, particle accelerators and detectors, large processing chambers such as mirror coaters, and experimental chambers such as LIGO interferometer arms or Kaon decay pipes.

Turbomolecular pumps would be the pumps of choice for these applications. However, conventional turbomolecular pumps are designed for high compression rates and only moderate pumping velocities, because their designs become quite difficult when scaling up to ultra high pumping speeds. Disadvantages to using turbomolecular pumps in such situations include: acquisition cost, the need for bearing regeneration or replacement, maintenance costs such as bearing replacements, contamination of the process chamber.

Because of these disadvantages, diffusion pumps, cryopumps, titanium sputter pumps and getter pumps are generally employed instead.

Thus, there is presently a need for an ultra high pumping speed vacuum evacuation apparatus, system, and method capable of reaching ultra high vacuum. There is additionally a need that such a vacuum evacuation apparatus be low cost, require minimum repair, have very high reliability, and have a very long life.

SUMMARY OF THE INVENTION

The above and other shortcomings are overcome by the present ultra high-speed vacuum pump turbofan, vacuum pump system that includes an ultra high-speed turbofan input stage backed by a conventional turbomolecular pump, and a method of using the same. Embodiments of the present vacuum pump system exhibit, but are not limited to, one or more of the following advantageous operational features:

(a) ultra high evacuation pumping speeds;
(b) low rotational speed and low centrifugal forces;
(c) capability of being employed in a preexisting low pressure, and thus exhibiting low resistance from a fluid;
(d) simpler, less expensive bearing and rotor design due to low resistance and centrifugal forces;
(e) high reliability, high cleanliness and low outgassing;
(f) capability of being placed substantially within a process chamber;
(d) crash protection mechanisms that can withstand sudden exposure to high pressure;
(e) capability of being employed as a prepump or precompressor pump in conjunction with a conventional turbomolecular pump, or as a back-up pump in connection with another turbofan.

In one embodiment, a turbofan, preferably employed as an input stage in connection with a conventional turbomolecular pump, is characterized by ultra-high pumping speeds, preferably large diameters, and moderate compression. The turbofan comprises one or more stator and rotor blade sets contained in an impermeable housing or within the evacuation chamber itself. The rotor blades extend radially from a rotatable longitudinal shaft. The stator blades, which alternate with the rotor blades, are fixed and extend from the pump housing toward the rotatable shaft. The stator blades are spaced longitudinally between the rotor blades. The rotor and stator blades may be contoured or grooved to promote directional fluid flow.

The rotor blades of the present turbofan are capable of rotating at a high linear blade velocity, to impart an ultra high pumping speed to a fluid stream, while remaining stabilized and without requiring a large power source for blade operation.

The present turbofan is preferably employed in a preexisting low pressure environment. In such an environment it is believed that this results in low axial forces exerted upon the rotors from the fluid stream to be evacuated. It is believed that because of the low axial forces, the present turbofan can preferably employ a passive magnetic bearing with a geometrical configuration in which a point contact stabilizes the longitudinal positioning of the shaft. Additionally, because relatively simple bearing components can be employed, the turbofan is capable of being very reliable and can thus be placed substantially or entirely within a process chamber.

Additionally, the rotor or stator fan blades can be equipped with a series of concentric crash wire rings on their surface. In cases of sudden large fluid influx, for example, due to vacuum vessel failure or operator error, the fan blades would be forced upstream with great force. The rotor blades would then contact the crash wires, which provide support and very rapid deceleration.

The ultra high speed turbofan is preferably employed in, although not limited to, a vacuum pump evacuation system comprising one or more first stage turbofans, as described above, upstream from one or more second stage conventional turbomolecular pump. Roughing pumps and/or forepumps can also be employed in the vacuum pump evacuation system.

Another aspect of the presently described technology is a method for evacuating a vacuum chamber comprising:

- disposing a turbofan, as described above, downstream from an evacuation chamber;
- disposing a conventional turbomolecular pump in fluid communication with the first stage turbofan;
- rotating the shaft such that the rotor blades cooperate with the stator blades to impart a velocity to a fluid stream directed from the turbofan inlet to a turbomolecular pump outlet.

In the present application, a fluid stream is defined as meaning a gas stream, a liquid stream, a liquid stream in which solid particles are entrained or dispersed, and/or a gas stream in which liquid droplets and/or solid particles are entrained or dispersed. The present technology preferably acts upon a mostly or entirely gaseous fluid stream.

BRIEF DESCRIPTION OF THE DRAWINGS

FIG. 1 is a perspective view showing an internal construction of a turbofan in accordance with one embodiment of the present apparatus system and method of use.

FIG. 2 is a partial sectional view, taken in the direction of arrows 2—2 in FIG. 1, showing the spatial relationship of the stator blades and rotor blades within a turbofan in accordance with at least one embodiment of the present apparatus, system and method of use.

FIG. 3 is a perspective view, taken in the direction of arrows 3—3 in FIG. 2, showing internal construction of a turbofan employing crash protection rings in accordance with at least one embodiment of the present apparatus, system and method of use.

DETAILED DESCRIPTION OF PREFERRED EMBODIMENT(S)

Figure 4:
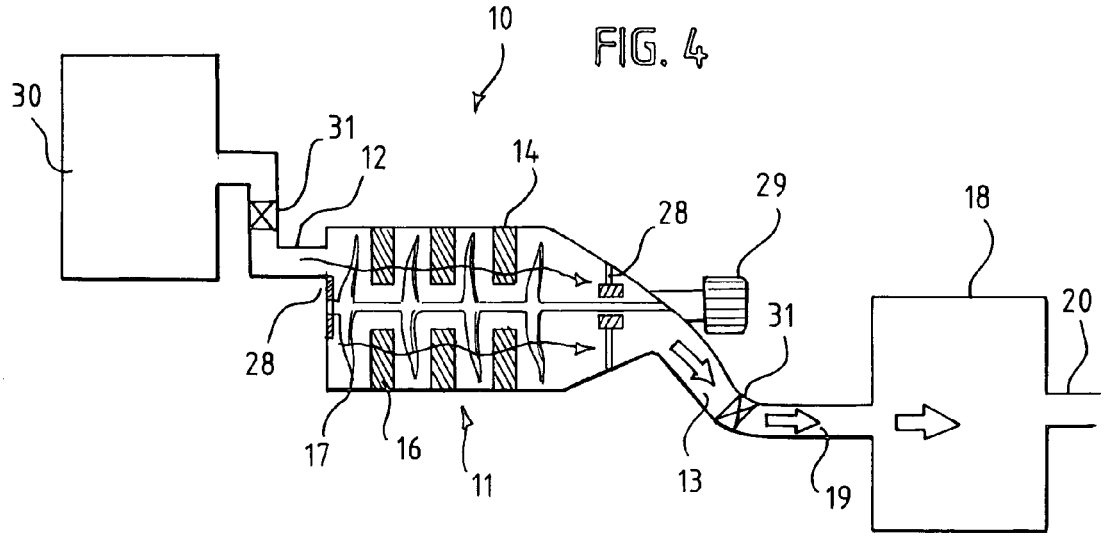
FIG. 4 is a partial schematic block diagram of a high vacuum pumping system in accordance with at least one embodiment of the present apparatus, system, and method of use showing a turbofan stage in fluid communication with an evacuation chamber and backing turbo-molecular pump.
Figure 5:
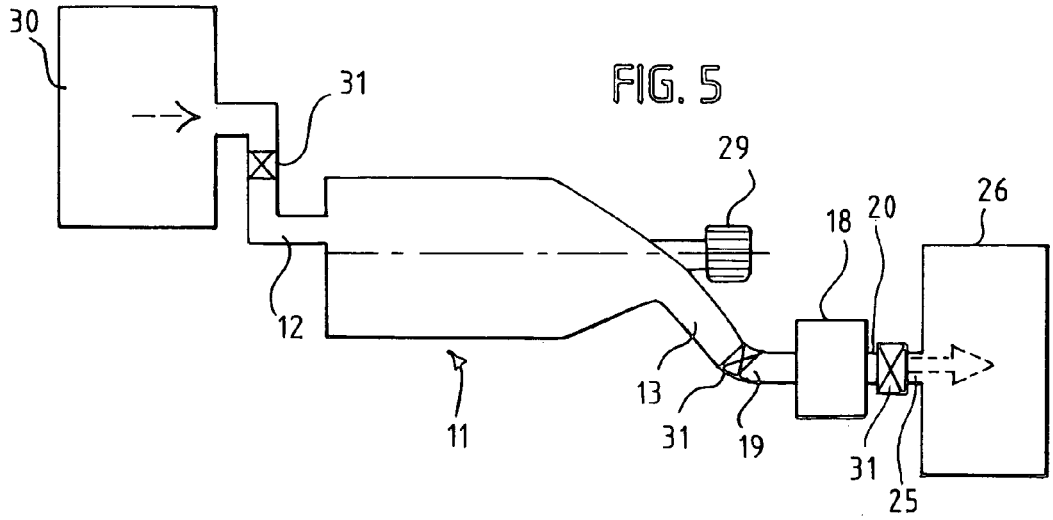
FIG. 5 is a partial schematic block diagram of a high vacuum pumping system in accordance with at least one embodiment of the present apparatus, system, and method of use, showing a turbofan stage in fluid communication with an evacuation chamber, forepump, turbomolecular pump, and roughing pump.

Shown in FIG. 1 of the drawings is one embodiment of an ultra high speed vacuum pump turbofan 11, which is preferably employed as an ultra-high speed input stage, backed by a conventional turbomolecular pump. Turbofan 11 acts to draw a fluid stream into a turbofan inlet 12 and through to a turbofan outlet 13. Preferably, this outlet fluidly communicates with at least one additional turbofan or turbomolecular pump, as shown in FIG. 4 and FIG. 5. Also preferably, the turbofan inlet 12 fluidly communicates with an evacuation or process chamber 30, as shown in FIG. 4 and FIG. 5. Turbofan 11 is characterized by a ultra high pumping speed and moderate compression ratios.

Typical pumping speeds are greater than 10,000 liters/second. More preferably, the pumping speeds are from 10,000 liters/second to 40,000 liters/second. In a preferred embodiment, turbofan 11 has a pumping speed of about 25,000 liters/second for a 1.0 meter diameter turbofan.

Turbofan 11 need only have moderate compression ratios when preferably employed as the first stage in a vacuum pump evacuation system 10, with a conventional turbomolecular pump 18 as a second stage, as shown in FIG. 4. Typical compression ratios are from about 1000× compression to 10× compression. More preferably, compression ratios range from 200× to 50×.

In one example, a turbofan 11 with a modest 100× compression ratio and a 1 m diameter will have a pumping speed of about 25,000 liters/second for air and can be backed up by a 250 liters/second turbomolecular pump 18 placed behind an isolation valve of 15 centimeters diameter or less. Pressures well below $10^{-8}$ Torr can be readily achieved with the present design.

Turbofan 11 is preferably employed in a pre-existing high vacuum environment. Exceptional operation in a different environment is discussed below. For example, the turbofan 11 can be disposed substantially or entirely within a process chamber, or connected fluidly to a process chamber, at a pressure that is held below at least about $10^{-3}$ Pa. More preferably, the pre-existing low pressure is held below about $10^{-5}$ Pa. Most preferably, the pre-existing low pressure is held below about $10^{-6}$ Pa. The present ultra-high speed turbofan, evacuation system, and method, are capable of further evacuating a chamber to pressures below $10^{-8}$ Pa.

In a pre-existing high vacuum environment, the fluid forces on the rotor blades 17 are extremely small. The fluid forces are typically one millionth of a Newton per square meter or less. It is believed, while not limited to any particular theory, that this condition allows the use of a rotor blade 17 design, discussed below, characterized by a flexible or semi-flexible thin foil structure, which is stretched and kept in the required shape by the action of the centripetal force while the rotor is spinning. This design alternative offers the prospect of light weight and reduced cost of the turbofan.

Additionally, it is believed that the small axial forces upon the rotors 17 allow the use of relatively simple, inexpensive, and reliable bearing designs, as discussed below.

Furthermore, it is believed that because of the small fluid forces exerted upon the rotors, the turbofan 11 is capable of utilizing larger diameters than conventional turbomolecular pumps. Typical turbofan 11 diameters are from about 0.1 meters to 3.0 meters. More preferably, the turbofan 11 diameter is from 0.5 to 1.5 meters. Most preferably, the turbofan 11 diameter is about 1 meter. Unencumbered by the need to compress gases to pressures that match the pump capability of the roughing pump, such turbofans would carry no large penalty in cost or complexity when going to the large diameters for ultra high pumping speeds. The large linear blade velocities that are required in turbo pumps can be reached at lower rotational speeds as the diameter becomes larger, which lowers stresses in the blades.

Other advantages of the turbofan 11, believed to be at least in part due to the small fluid forces, include the capability of utilizing a low power motor and inexpensive, relatively simple stabilization components, as discussed below.

Figure 6:
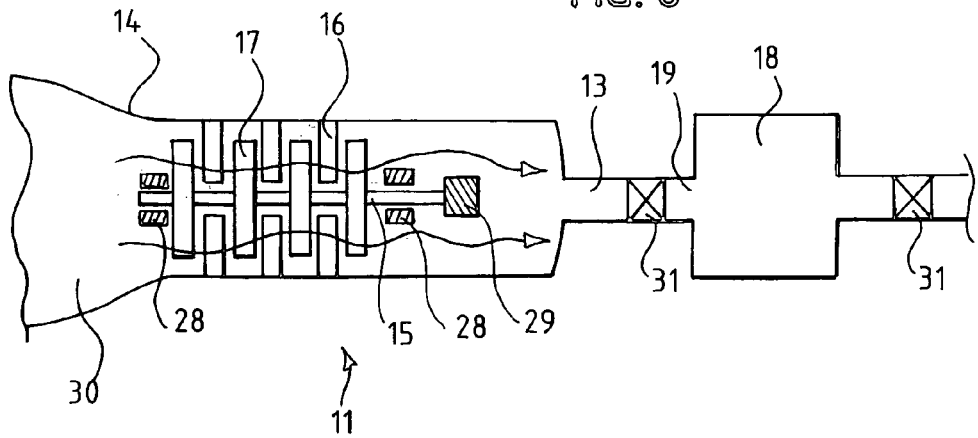
FIG. 6 is a partial schematic block diagram of a high vacuum pumping system in accordance with at least one embodiment of the present apparatus, system, and method of use, showing a turbofan stage substantially disposed within an evacuation chamber.

Turbofan 11 shown in FIG. 1, then, comprises one or more turbomolecular pump-like, turbine-like or fan-like stator blades 16 and rotor blades 17 contained in an impermeable housing 14, positioned adjacent to the evacuation or process chamber 30. Alternatively, turbofan 11 can be positioned directly in an evacuation or process chamber 30 as shown in FIG. 6. Because of the relatively simple, inexpensive, negligibly outgassing, and reliable components of the turbofan 11, it can be employed substantially or entirely within an evacuation or process chamber 30, as shown in FIG. 6. In this case, the turbofan will be significantly less costly than even a 1 meter diameter Ultra High Vacuum (UHV) valve.

Rotor blades 17 are mounted radially on a rotatable longitudinal shaft 15. Rotor blades 17 are preferably fan-like, turbomolecular-pump-like, or turbine-like except that a portion of the rotor blades, preferably from the rotational axis out to anywhere up to the half-radius, may be non-transparent to the fluid to inhibit fluid backflow. Shaft 15 is preferably held by at least one low friction or frictionless bearing 28. It is also preferable that shaft 15 is entirely contained within housing 14.

Stator blades 16, meanwhile, are fixed blades extending from the pump housing 14 towards the rotatable shaft 15. Stator blades 16 are spaced longitudinally between rotor blades 17, as shown in FIG. 2. Stator blades 16 can be contoured and/or slanted to promote directional fluid flow. An example of grooved stator blades is shown in FIG. 3.

Turbofan stator 16 and rotor blades 17 are preferably made from a lightweight, strong material. Such blades can be made from materials including, but not limited to, titanium, aluminum, and other materials employed in turbine based fans, industrial fans, and turbomolecular pumps. Rotor blades 17 are preferably composed of a material that maintains its shape when stopped, and resist forces due to centrifugal acceleration, rotational acceleration, and forces from the fluid flow and fluid pressure differences.

Rotor blades 17 can touch stator 16 blade assemblies if motor 29 has sufficient torque to start shaft 15 and rotor blades 17 against that small friction force. Rotor blades 17 additionally are preferably thin and flexible such that they can be stabilized by centrifugal force when spinning. Further, rotor blades 17 preferably are sufficiently well balanced to satisfy bearing requirements.

Also attributable to the small fluid forces and small axial forces on the rotatable shaft 15 and rotor blades 17, the turbofan is capable of being driven by a low power motor 29. For example, rotatable shaft 15 and rotor blades 17 can be driven by a motor assembly suspended inside the housing 14 and cooled via small steel pipes. More preferably, rotatable shaft 15 and rotors can be driven by an alternating current (AC) motor 29 with an enclosed or canned rotational component on the downstream end of the shaft 15 in the vacuum and a stationary component outside the vacuum envelope. This configuration has the advantage of leaving only non-contact, passive elements inside the vacuum envelope, enabling low outgassing, extreme reliability and an increased lifetime. Optionally, an external motor can be employed, provided that sufficient hermetic seals are also employed to ensure that a high vacuum is maintained. Preferably, the motor 29 is capable of operating at variable speeds. Alternatively, the motor may operate at a fixed speed.

The present turbofan rotor blades 17 are capable of rotating at a high linear blade velocity to impart a high pumping speed while remaining stabilized and without requiring a large-capacity power source for stabilization assistance. Conventional turbomolecular pumps typically employ oiled or greased bearings that are vented to the high pressure side of the pump. Pumps with active or passive magnetic bearings are commercially available and are generally employed in oil-free applications. Such magnetic bearings are expensive, however, and are sometimes not as reliable as lubricated bearings due to the complexity of the active feedback system normally employed to center the rotational shaft and rotors. Additionally, turbomolecular pumps that are constructed using passive magnetic bearings are not normally stable in all degrees of freedom, however. Magnetic bearings, therefore, typically employ either an active feedback system or a design in which a conventional lubricated bearing stabilizes the magnetic bearing.

It is believed, while not limited to any particular theory, that due to the small fluid forces upon the rotors and the small axial force of the rotatable turbofan shaft 15 and rotor blades 17, a passive magnetic bearing 28 can be used that employs a geometrical configuration in which a point contact (including, but not limited to steel on a diamond plate) stabilizes the longitudinal positioning of the rotatable turbofan shaft 15. Stabilization of small axial forces can also be achieved using diamagnetic materials like carbon.

Another option that can be employed in the presently described technology is dynamic repulsion of magnetic fields through the use of a conducting ring. A particularly preferred design employs a diamagnetic or dynamic repulsive stabilizer, backed by a point contact for large force occurrences. The point contact is, in turn, backed by a dry slide ring or dry ball bearing for very large forces such as can occur during air in-rush or a physical shock to the evacuation pump system.

The turbofan shaft 15, then, is preferably held in place by a permanent magnetic bearing 28. An additional slip ring, not normally contacting the shaft, can be employed to restrict shaft excursion during extreme force conditions.

By employing passive magnetic bearings with an optional stabilization point contact, only non-contact, passive, low-outgassing components are located inside the vacuum chamber. This results in low chamber contamination, high reliability and a longer operational life. In addition, these bearing options are less expensive and more reliable than those employed in conventional turbomolecular pumps.

Regardless of the specific design and material of the rotor blades, it is preferred that a vacuum pump be designed to survive a sudden and unexpected influx of fluid of such magnitude that normal operation cannot take place and fluid forces can become large and possibly destructive. Examples of such events are malfunction of or damage to the impermeable housing or the pump or the evacuation chamber and/or its appendages.

It is believed that the turbofan 11, having preferably a large diameter to enable it to provide ultra high pumping speeds, is vulnerable to these fluid forces which occur under abnormal conditions, for example, when a large fluid mass invades the turbofan 11 while it is spinning at operating speed.

The turbofan can be protected from damage due to such abnormal forces by adding crash protection devices, as shown in FIG. 3. While a turbofan can function well without crash protection devices, and can be on occasion employed without said devices, a preferable embodiment of a turbofan includes such devices.

During abnormal operating events, the primary fluid forces can be large enough to overstress blades of most designs. The preferred embodiment of the turbofan blades has blades of sufficient flexibility to flex under those forces, rather than breaking. When the blades flex they may touch the stator blades. The rotor and stator blades could enmesh and break.

This can be prevented by the crash protection device 27 as shown in FIG. 3. This device works by providing a slip surface 27*a* between the each rotor 17 and the downstream stator blade assembly 16. The flexing rotor blades 17 ride on the slip surface for the brief time it takes for the rotor 17 to come to a halt. The slip surface is preferably mostly transparent to the fluid and is preferably constructed of vacuum compatible material. One possible embodiment uses a plurality of circular concentric wire rings 27*b* as shown in FIG. 3, either as a free standing screen, or attached to and supported by the stator blade assembly.

With the above-described embodiments and features of the turbofan 11 in mind, then, FIG. 4 shows the turbofan 11 in its preferred use in a system 10, as a first stage (that is, a precompression or pre-pump) ultra-high speed vacuum pump, upstream from a second stage conventional turbomolecular pump 18. First-stage turbofan 11 provides ultra high pumping speeds, with moderate compression, as indicated above, while second stage conventional turbomolecular pump 18 provides high compression pumping. The system shown in FIG. 4 comprises a first stage turbofan 11, as discussed above, fluidly connected to a chamber 30 to be evacuated. A hermetic valve can be employed at the connection point between the turbofan inlet 12 and the evacuation chamber outlet. Optionally, first stage turbofan 11 can be disposed within the chamber to be evacuated, with an outlet port 13 extending from the evacuation chamber.

Downstream from turbofan 11, a second stage conventional turbomolecular pump 18 can be connected in fluid communication with turbofan 11. A hermetic valve or seal 31 can be employed at the junction between the turbofan outlet 13 and turbomolecular pump inlet 19. The turbomolecular pump 18, in turn, can be connected in fluid communication to a roughing pump 26, as shown in FIG. 5, or can vent to a second chamber or to atmosphere. Once again, a hermetic valve or seal can be employed at the junction between turbomolecular pump outlet 20 and roughing pump inlet 25. The roughing pump preferably then vents to atmosphere at an outlet.

Optionally, as shown in FIG. 5, the vacuum pump evacuation system 10 can employ additional pre-pumps or precompression pumps, locatable between the evacuation chamber 30 and turbofan 11. Additionally, the vacuum pump evacuation system 10 can employ additional roughing pumps 26 after the conventional turbomolecular pump.

The vacuum pump evacuation system can also employ more than one turbofan 11 as a back-up, multi-stage, or redundant fan, due to the comparative low materials cost of such a turbofan. The additional turbofans can be employed in series in the vacuum pump evacuation system, or as parallel components with or without hermetic bypass valves.

In operation, the foregoing turbofan and vacuum pump system can evacuate a vacuum chamber in the following manner. First, the ultra high-speed turbofan 11 is disposed either downstream from the chamber 30 to be evacuated or substantially or entirely within it, and in fluid communication with the chamber 30. Preferably, the chamber to be evacuated and the ultra-high speed turbofan are then maintained at a pre-existing low pressure, as described above. Next, turbomolecular pump 18 is disposed downstream from turbofan 11, and is fluidly connected at its inlet port 19 to outlet port 13 of turbofan 11. Preferably, this turbomolecular pump 18 is separated from the turbofan 11 by a hermetic valve. Preferably, this valve remains closed when the system is not in operation, in order to maintain a pre-existing vacuum in the turbofan and chamber to be evacuated. Alternatively, the turbofan 11 itself may be evacuated before turbofan start-up.

Upon start-up of the turbofan 11, shaft 15 is rotated about its longitudinal axis such that rotor blades 17 cooperate with stator blades 16 to impart a velocity to a fluid stream drawn through the turbofan inlet 12 and exhausted at turbofan outlet 13. Thereafter, the fluid stream is further compressed and transferred downstream by turbomolecular pump 18. Additional forepumps and/or backing pumps can be employed, as described above.

While particular steps, elements, embodiments and applications of the present invention have been shown and described, it will be understood, of course, that the invention is not limited thereto since modifications can be made by persons skilled in the art, particularly in light of the foregoing teachings. It is therefore contemplated by the appended claims to cover such modifications and incorporate those steps or elements that come within the scope of the invention.

What is claimed is:

1. A vacuum pump evacuation system comprising:

(a) a first stage comprising a turbofan comprising:

(1) a fluid-containing housing having a fluid stream inlet and a fluid stream outlet;

(2) a shaft rotatably mounted within said housing, said shaft having a longitudinal axis;

(3) a plurality of fixed stator blades extending from said housing toward the longitudinal axis of said shaft, said stator blades longitudinally spaced between said turbofan fluid stream inlet and said turbofan fluid stream outlet;

(4) a plurality of rotor blades extending radially from said shaft, said rotor blades rotatable about said shaft longitudinal axis, said rotor blades longitudinally spaced between said turbofan fluid stream inlet and said turbofan fluid stream outlet; and (b) a second stage comprising a turbomolecular pump having a fluid stream inlet and a fluid stream outlet, said turbomolecular pump inlet fluidly communicating with said turbofan outlet;

whereby, upon rotation of said shaft about its longitudinal axis, said stator and rotor blades cooperate to impart an axial velocity to a fluid stream drawn into said turbofan fluid stream inlet, thereby directing a pressurized fluid stream from said turbofan fluid stream outlet to said turbomolecular pump fluid stream inlet.

2. The vacuum pump evacuation system of claim 1 wherein the system pumping speed is greater than 10,000 liters/second.

3. The vacuum pump evacuation system of claim 2 wherein the system pumping speed is in the range 10,000–40,000 liters/second.

4. The vacuum pump evacuation system of claim 1 wherein the rotor blade diameter is in the range 0.1–3.0 meters.

5. The vacuum pump evacuation system of claim 4 wherein the rotor blade diameter is in the range 0.5–1.5 meters.

6. The vacuum pump evacuation system of claim 1 wherein said first stage turbofan operates at a preexisting pressure of less than $10^{-5}$ Pa.

7. The vacuum pump evacuation system of claim 1 wherein said first stage turbofan produces a gas compression ratio in the range 10×–1000×.

8. The vacuum pump evacuation system of claim 1 wherein the first stage turbofan is disposed within a chamber to be evacuated.

9. The vacuum pump evacuation system of claim 1 wherein said turbofan further comprises a crash protection mechanism to prevent contact between the rotor and stator blades during abnormal operating events.

10. The vacuum pump evacuation system of claim 9 wherein said crash protection mechanism comprises a plurality of concentric rings extending from said housing, said plurality of concentric rings encasing said stator blades or said rotor blades, said concentric rings being transparent to the fluid.

11. The vacuum pump evacuation system of claim 1 wherein said turbofan shaft is rotatably mounted on said housing by a frictionless bearing mechanism.

12. The vacuum pump evacuation system of claim 11 wherein said frictionless bearing mechanism comprises a passive magnetic bearing having a geometric configuration in which a point of contact maintains the orientation of said shaft longitudinal axis with respect to said housing.

13. The vacuum pump evacuation system of claim 1 further comprising a roughing pump positioned downstream from said second stage turbomolecular pump.

14. A method of evacuating a fluid stream from a vacuum chamber comprising:

(a) disposing a turbofan downstream from said vacuum chamber, said turbofan comprising: (i) a fluid-containing housing having a fluid stream inlet and a fluid stream outlet, (ii) a shaft rotatably mounted within said housing, said shaft having a longitudinal axis, (iii) a plurality of fixed stator blades extending from said housing toward the longitudinal axis of said shaft, said stator blades longitudinally spaced between said turbofan fluid stream inlet and said turbofan fluid stream outlet, and (iv) a plurality of rotor blades extending radially from said shaft, said rotor blades rotatable about said shaft longitudinal axis, said rotor blades longitudinally spaced between said turbofan fluid stream inlet and said turbofan fluid stream outlet;

(b) disposing a turbomolecular pump downstream from said turbofan, said turbomolecular pump having a fluid stream inlet and a fluid stream outlet, said turbomolecular pump inlet fluidly communicating with said turbofan outlet;

(c) rotating said shaft about its longitudinal axis such that said rotor blades cooperate with said stator to impart an axial velocity to a fluid stream drawn from the vacuum chamber into said turbofan fluid stream inlet, thereby directing a pressurized fluid stream from said turbofan fluid stream outlet.

15. The method of claim 14, wherein the fluid is pumped out of the chamber at a rate of greater than 10,000 liters/second.

* * * * *